US012290110B2

(12) United States Patent
Abi Aoun

(10) Patent No.: US 12,290,110 B2
(45) Date of Patent: May 6, 2025

(54) AEROSOL PROVISION SYSTEM

(71) Applicant: Nicoventures Trading Limited, London (GB)

(72) Inventor: Walid Abi Aoun, London (GB)

(73) Assignee: NICOVENTURES TRADING LIMITED, London (GB)

( * ) Notice: Subject to any disclaimer, the term of this patent is extended or adjusted under 35 U.S.C. 154(b) by 250 days.

(21) Appl. No.: 17/756,486

(22) PCT Filed: Nov. 27, 2020

(86) PCT No.: PCT/EP2020/083801
§ 371 (c)(1),
(2) Date: May 26, 2022

(87) PCT Pub. No.: WO2021/105479
PCT Pub. Date: Jun. 3, 2021

(65) Prior Publication Data

US 2023/0000169 A1 Jan. 5, 2023

(30) Foreign Application Priority Data

Nov. 29, 2019 (GB) ..... 1917451

(51) Int. Cl.

| | |
|---|---|
| ***A24F 40/57*** | (2020.01) |
| ***A24F 40/20*** | (2020.01) |
| ***A24F 40/30*** | (2020.01) |
| ***A24F 40/42*** | (2020.01) |
| ***A24F 40/46*** | (2020.01) |

(52) U.S. Cl.
CPC ..... *A24F 40/57* (2020.01); *A24F 40/20* (2020.01); *A24F 40/30* (2020.01); *A24F 40/42* (2020.01); *A24F 40/46* (2020.01)

(58) Field of Classification Search
CPC ..... A24F 40/57; A24F 40/20; A24F 40/30; A24F 40/42; A24F 40/46; A24F 40/50
See application file for complete search history.

(56) References Cited

U.S. PATENT DOCUMENTS 9,609,893 B2 * 4/2017 Novak, III ..... H05B 3/46
9,955,726 B2 * 5/2018 Brinkley ..... F22B 1/284
(Continued)

FOREIGN PATENT DOCUMENTS

CN 107427086 A 12/2017
JP H06315366 A 11/1994
(Continued)

OTHER PUBLICATIONS

International Search Report and Written Opinion for Application No. PCT/EP2020/083801, mailed on Apr. 12, 2021, 10 pages.
(Continued)

*Primary Examiner* — Truc T Nguyen
(74) *Attorney, Agent, or Firm* — Husch Blackwell

(57) ABSTRACT

A method of generating aerosol from a consumable is disclosed. The consumable comprises a corrugated surface having troughs extending along the consumable in an axial direction, the troughs being provided with aerosol generating material. The method comprising sequentially supplying heat to selected one or more troughs, such that at a given time, heat is directly applied to the selected one or more troughs by a heating element.

16 Claims, 8 Drawing Sheets

(56) References Cited

U.S. PATENT DOCUMENTS

| | | | | |
|---|---|---|---|---|
| 10,226,073 | B2 * | 3/2019 | Bless | A24F 40/53 |
| 11,019,685 | B2 * | 5/2021 | Bowen | H05B 1/0244 |
| 2017/0055584 | A1 * | 3/2017 | Blandino | A24F 40/00 |
| 2019/0124986 | A1 * | 5/2019 | Blattler | A24F 40/42 |
| 2019/0289908 | A1 | 9/2019 | Worm et al. | |
| 2020/0008471 | A1 * | 1/2020 | Reevell | A24F 40/46 |

FOREIGN PATENT DOCUMENTS

| | | | |
|---|---|---|---|
| WO | 2013102609 | A2 | 7/2013 |
| WO | 2013178769 | A1 | 12/2013 |
| WO | WO-2014102092 | A1 | 7/2014 |
| WO | 2015114328 | A1 | 8/2015 |
| WO | WO-2015155289 | A1 | 10/2015 |
| WO | 2017202965 | A1 | 11/2017 |
| WO | 2018235956 | A1 | 12/2018 |
| WO | WO-2019211311 | A1 | 11/2019 |

OTHER PUBLICATIONS

"International Preliminary Report on Patentability received for PCT Patent Application No. PCT/EP2020/083801, mailed on Jun. 9, 2022", 8 pages.

CN Office Action in Chinese Patent Application No. 202080082565.2, mailed on Feb. 23, 2025, 12 pages.

* cited by examiner

AEROSOL PROVISION SYSTEM

PRIORITY CLAIM

The present application is a National Phase entry of PCT Application No. PCT/EP2020/083801, filed Nov. 27, 2020, which claims priority from Great Britain Application No. 1917451.5, filed Nov. 29, 2019, each of which is hereby fully incorporated herein by reference.

TECHNICAL FIELD

The present disclosure relates to a method of producing an aerosol from a consumable, an aerosol provision system and aerosol provision means.

BACKGROUND

Aerosol provision systems are known.

Aerosol generating component are used in aerosol provision system to provide aerosols from aerosol generating material. The aerosol generating component may be oscillators or heaters or the like. When aerosol generating material is inserted into the aerosol provision system, effective aerosolization can be provided by a suitably arranged aerosol generating component. Modern devices often tailor the aerosol generating component and the aerosol generating material to provide a desirable aerosol for inhalation. Flexibility in this tailoring need is desirable.

The present disclosure is directed toward solving some of the above problems.

SUMMARY

In accordance with some embodiments described herein, there is provided a method of generating aerosol from a consumable, the consumable comprising a corrugated surface having troughs extending along the consumable in an axial direction, the troughs being provided with aerosol generating material; the method comprising sequentially supplying heat to selected one or more troughs, such that at a given time, heat is directly applied to the selected one or more troughs by a heating element.

Supplying heat to portions of the consumable may comprise activating a heating element.

Sequentially supplying heat to selected ones of the troughs may comprise moving the heating element relative to the consumable substantially along a direction perpendicular to the axial direction.

The method may further comprise moving the heating element relative to the consumable substantially around an axis parallel to the axial direction.

Sequentially supplying heat to portions of the consumable may comprise moving the heating element relative to the consumable substantially along the axial direction.

The method may further comprise moving the heating element relative to the consumable to provide contact between the heating element and the consumable.

Sequentially supplying heat to portions of the consumable may further comprise moving the heating element relative to the consumable to heat a first trough and then an adjacent trough.

The method may further comprise selecting a heating option from at least one of: a predetermined heating profile comprising a plurality of heating phases; and a heating period, to be applied to the consumable.

Sequentially supplying heat to the selected one or more troughs may comprise moving the heating element relative to the consumable in or more directions.

In accordance with some embodiments described herein, there is provided an aerosol provision system comprising: a heating element for generating an aerosol from an aerosol generating material; and, a consumable comprising a corrugated surface having troughs extending along the consumable in an axial direction, the troughs being provided with aerosol generating material; the heating element arranged to supply heat to selected one or more troughs, such that at a given time, heat is directly applied to the selected one or more troughs by the heating element.

The system may further comprise a movement mechanism arranged to provide relative movement between the heating element and the consumable substantially along a direction perpendicular to the axial direction.

The movement mechanism may be arranged to move the heating element relative to the consumable substantially along the axial direction.

The movement mechanism may be further arranged to provide relative movement between the heating element and the consumable substantially around an axis parallel to the axial direction.

The consumable may comprise a channel extending along the consumable in an axial direction wherein the heating element when in use, may be arranged within the channel of the consumable.

The system may further comprise: control circuitry arranged to control the heating element so as to provide a selection between at least: a predetermined aerosol generating profile comprising a plurality of aerosolization phases; and an aerosolization period, which may be applied to the aerosol generating material.

The system may further comprise a first trough provided with a first aerosol generating material and a second trough provided with a second aerosol generating material, the first aerosol generating material and the second aerosol generating material being different aerosol generating media.

In accordance with some embodiments described herein, there is provided aerosol provision means comprising: an aerosol generating mechanism for generating an aerosol from an aerosol generating means; and, a consumable comprising corrugated surface means having troughs extending along the consumable in an axial direction, the trough means being provided with aerosol generating means, the heating element arranged to supply heat to selected one or more troughs, such that at a given time, heat is directly applied to the selected one or more troughs by the heating element.

BRIEF DESCRIPTION OF THE DRAWINGS

The present teachings will now be described by way of example only with reference to the following figure.

Figure 1:
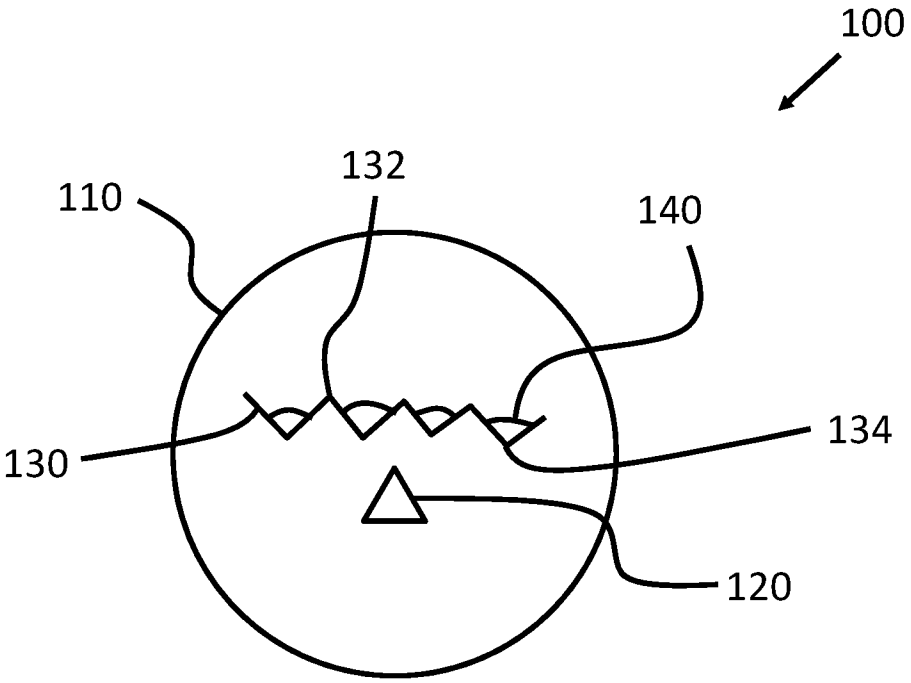
FIG. 1 is a cross-sectional view of an aerosol provision system according to an example.

While the disclosure is susceptible to various modifications and alternative forms, specific embodiments are shown by way of example in the drawings and are herein described in detail. It should be understood, however, that the drawings and detailed description of the specific embodiments are not intended to limit the disclosure to the particular forms disclosed. On the contrary, the disclosure covers all modifications, equivalents and alternatives falling within the scope of the present.

DETAILED DESCRIPTION OF THE DRAWINGS

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Throughout the following description the term "e-cigarette" or "electronic cigarette" may sometimes be used, but it will be appreciated this term may be used interchangeably with aerosol provision system/device and electronic aerosol provision system/device. Furthermore, and as is common in the technical field, the terms "aerosol" and "vapor", and related terms such as "vaporize", "volatilize" and "aerosolize", may generally be used interchangeably.

In the example of FIG. 1, an aerosol provision system 100 is shown. The aerosol provision system 100 is shown in a transverse cross-sectional view. The aerosol provision system 100 comprises an aerosol generating component 120. The aerosol generating component 120 is for generating an aerosol from an aerosol generating material. The aerosol provision system 100 also comprises a consumable 130 comprising aerosol generating material 140. The consumable 130 comprises a corrugated surface 132 having troughs 134 extending along the consumable 130 in an axial direction. The troughs 134 are provided with aerosol generating material 140. The aerosol generating component 120 is arranged to supply heat to selected one or more troughs 134, such that at a given time, heat is directly applied to the selected one or more troughs 134 by the aerosol generating component 120.

The aerosol generating component 120 may be a heating element. The aerosol generating component 120 may be a heating mechanism or part of a heating mechanism. In an example, the aerosol generating component 120 may be a heater for providing heat to the aerosol generating material in the consumable 130. The aerosol generating component 120 may be a resistive heater to provide heat to the consumable 130 from a current passed through it by an electrically connected power source. The aerosol generating component 120 may be made of metal or ceramic or the like. Alternatively or additionally, the aerosol generating component 120 may be an induction heater or a part of an inductive heating system for providing heat to the consumable 130.

The consumable 130 may have aerosol generating material such as tobacco or the like arranged in the troughs 134 of the corrugated surface 132. The consumable 130 may be formed from placing aerosol generating material 140 onto a surface and subsequently corrugating the surface, by for example deforming the surface.

The heating element (otherwise referred to as "aerosol generating component") 120 may be formed to substantially conform to the troughs 134 of the corrugated surface 132 of the consumable 130. This enables the heating element 120 to project into the gaps in the corrugations in the surface 132. This in turn allows for more efficient heat transfer to the surface 132 and therefore to the aerosol generating material 140 arranged on the surface 132. Accordingly, this allows for less power to be used during any one smoking session than for a less correspondingly-shaped heating element and therefore leads to a longer charge life of the aerosol provision system 100.

The aerosol provision system 100 may have a housing 110 or the like within which the heating element 120 and the consumable 130 are arranged or inserted prior to use. The heating element 120 may be arranged within the consumable 130. The heating element 120 may be arranged external to or outside the consumable 130, but within the housing 110.

The surface 132 may be formed of a material which is thermally conductive to more easily allow heat to pass from the heating element 120 to the aerosol generating material 140 on the surface 132. In an example, the surface 132 may be formed of an inductive material, such as aluminum. This may allow for heating of the aerosol generating material 140 to occur via induction.

The heating element 120 may be a work coil which may work with an aluminum surface (or aluminum susceptor as part of the surface) to provide thermal energy to the aerosol generating material 140 in the consumable 130. Heating element 120 may be a collar which is moved to heat portions of the aerosol generating material 140 of the consumable 130. The collar may be made of any suitable material, such as ceramic or metal.

Figure 2A:
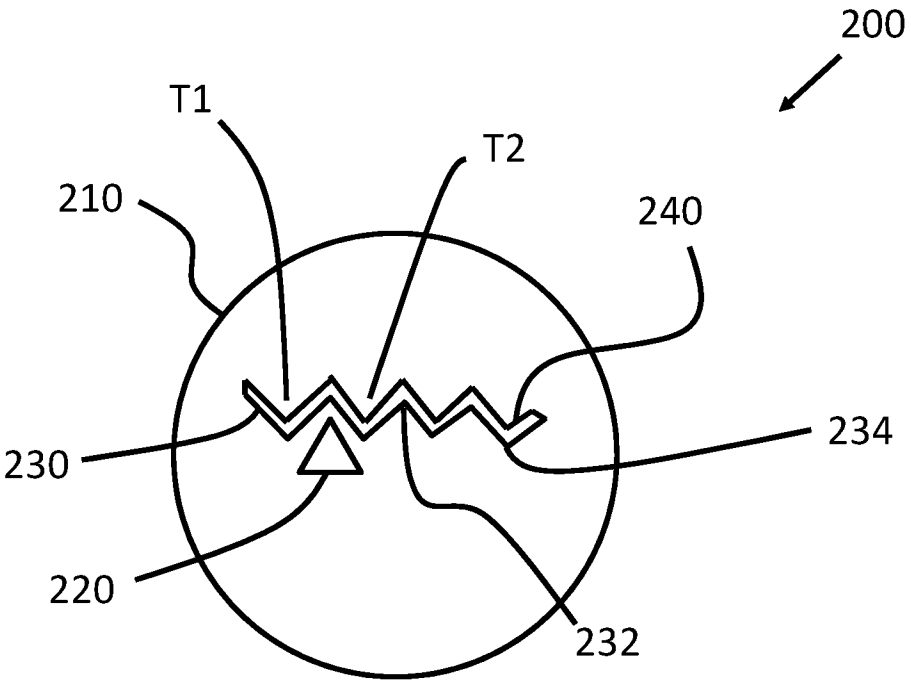
FIG. 2A is a transverse cross-sectional view of an aerosol provision system according to an example.

In the example of FIG. 2A, an aerosol provision system 200 is shown. The aerosol provision system 200 is shown in a transverse cross-sectional view. The aerosol provision system 200 has a housing 210, a heating element 220, a consumable 230 having a corrugated surface 232 with a plurality of troughs 234, with aerosol generating material 240 arranged over the surface 232. The aerosol generating material 240 arrangement of FIG. 2 differs slightly to that of FIG. 1, though both are suitable for the disclosed embodiments. The heating element 220 of FIG. 2 is shown projecting between two troughs T1, T2. The heat from the heating element 220 will provide thermal energy to the aerosol generating material 240 within those troughs and cause aerosolization of said aerosol generating material 240.

The movement of the heating element 220 between specific troughs allows the heating element 220 to selectively heat portions of the aerosol generating material 240 on the surface 232. The aerosol generating material 240 may vary on the surface 232 (and therefore troughs 234), for example different formulations may be provided in different troughs. For example, one trough may contain nicotine-containing aerosol generating material. In an example, another trough may contain a glycerol-containing aerosol generating material. In an example, a further trough may contain an acid-containing aerosol generating material.

The heating element 220 can be controlled to heat specific troughs thereby producing a specific aerosol. In this way, a personalized aerosol may be produced for inhalation by a user. The user experience of the system 200 is thereby improved.

In a specific example, the movement mechanism is arranged to provide relative movement between the heating element 220 and the consumable 230 along a line between heating element 220 and the consumable 230 to provide contact between the heating element 220 and the consumable 230. This provides for an effective heat transfer from the heating element 220 to the consumable 230.

Figure 2B:
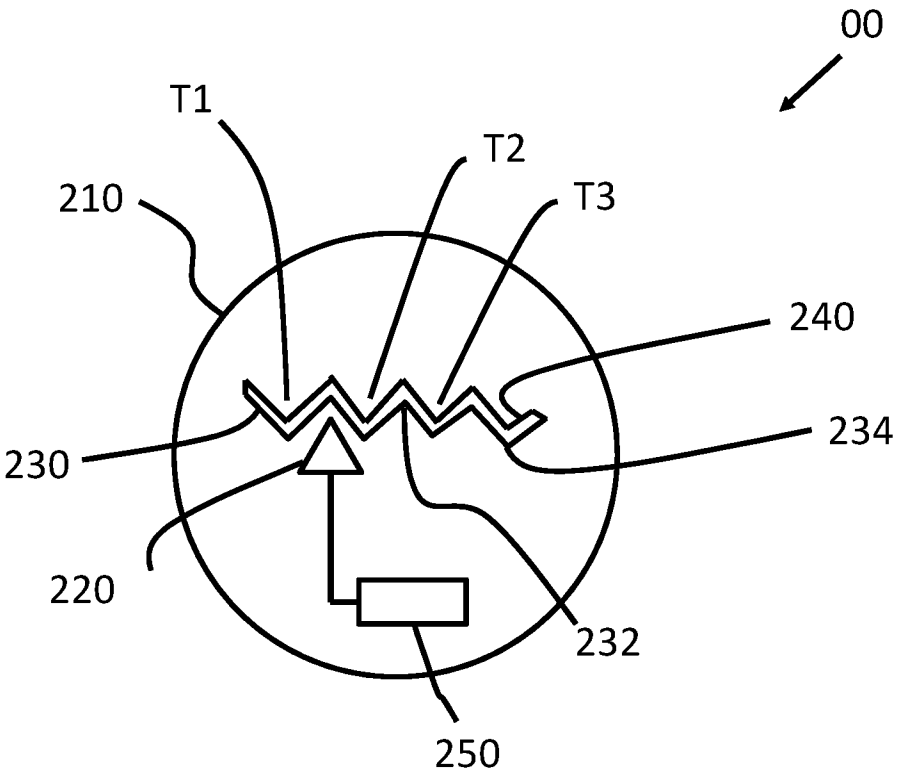
FIG. 2B is a transverse cross-sectional view of an aerosol provision system according to an example.

In the example of FIG. 2B, an aerosol provision system 200 is shown. The aerosol provision system 200 is shown in a transverse cross-sectional view. The aerosol provision system 200 has a movement mechanism 250 arranged to provide relative movement between the heating element 220 and the consumable 230 substantially along a direction perpendicular to the axial direction.

The movement mechanism 250 may be arranged to move the heating element 220 relative to the consumable 230 to heat a first trough T1, then a second trough T2 and then a third trough T3. The aerosol provision system 200 may allow for moving the heating element 220 relative to the consumable 230 to heat a first trough and then an adjacent trough. Alternatively, the aerosol provision system 200 may allow for moving the heating element 220 relative to the consumable 230 to heat a first trough e.g. T1, then a non-adjacent trough e.g. T3, then an adjacent trough e.g. T2. Control over the sequential, or non-sequential, heating of troughs may provide the user the option of creating a personalized aerosol as described above, particularly when the aerosol generating material 240 provided in troughs varies. Controlled selective heating of troughs may also allow a consumable 230 to be partially consumed during one smoking session but partially preserved for a later smoking session.

The movement mechanism 250 may be an indexing device such as a Geneva wheel or the like. The movement mechanism 250 may allow for relative movement of the heating element 220 in two dimensions perpendicular, or substantially perpendicular, to the axial direction. The "axial direction" being into the page in relation to the view shown in FIG. 2B.

The movement mechanism 250 may be arranged to move the heating element 220 relative to the consumable 230 along, or substantially along, the axial direction.

Figure 3:
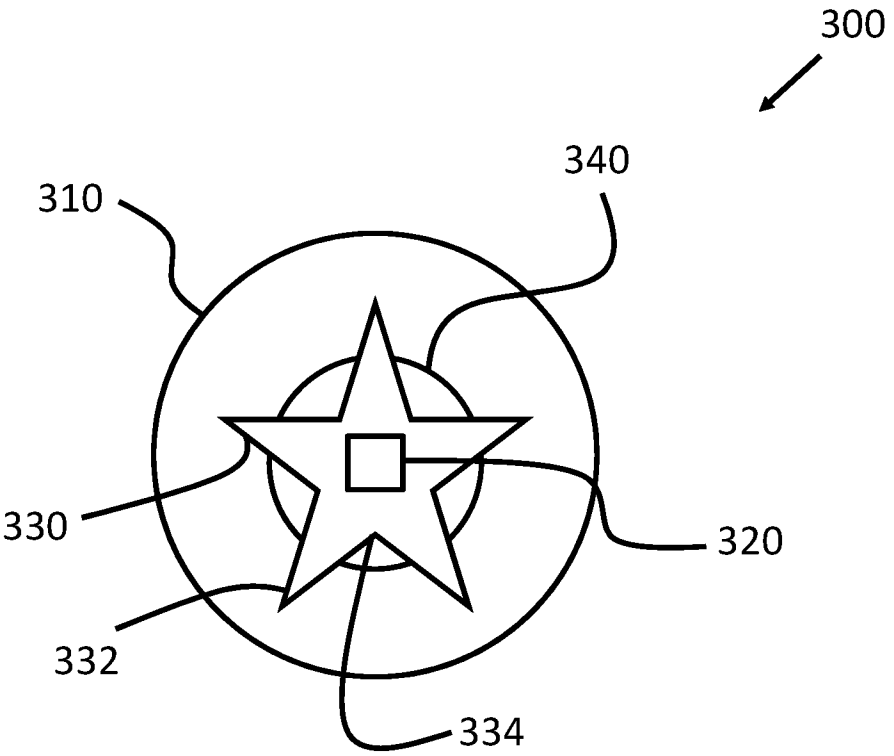
FIG. 3 is a transverse cross-sectional view of an aerosol provision system according to an example.

In the example of FIG. 3, an aerosol provision system 300 is shown. The aerosol provision system 300 is shown in a transverse cross-sectional view. The aerosol provision system 300 has a housing 310, a heating element 320, a consumable 330 having a corrugated surface 332 with a plurality of troughs 334, with aerosol generating material 340 arranged over the surface 332.

The consumable 330 has a corrugated surface 332 which has been formed so as to join back onto itself with a tubular transverse cross section. The corrugated surface 332 shown in the example of FIG. 3 is in the shape of a star, with the troughs 334 provided with aerosol generating material 340. The heating element 320 is arranged within the consumable 330, so to provide heat to the aerosol generating material 340 through the surface 332. The heating element 320 may be shaped to fit between the troughs 334 as described above, though the heating element 320 shown would not fit particularly well between the troughs 334.

The corrugated surface 332 may be formed by corrugating a flat surface. The tubular consumable 330 shown in FIG. 3 may be formed by joining the corrugated surface onto itself, for example by adhering the longitudinal edges of the surface 332 to one another.

Figure 4:
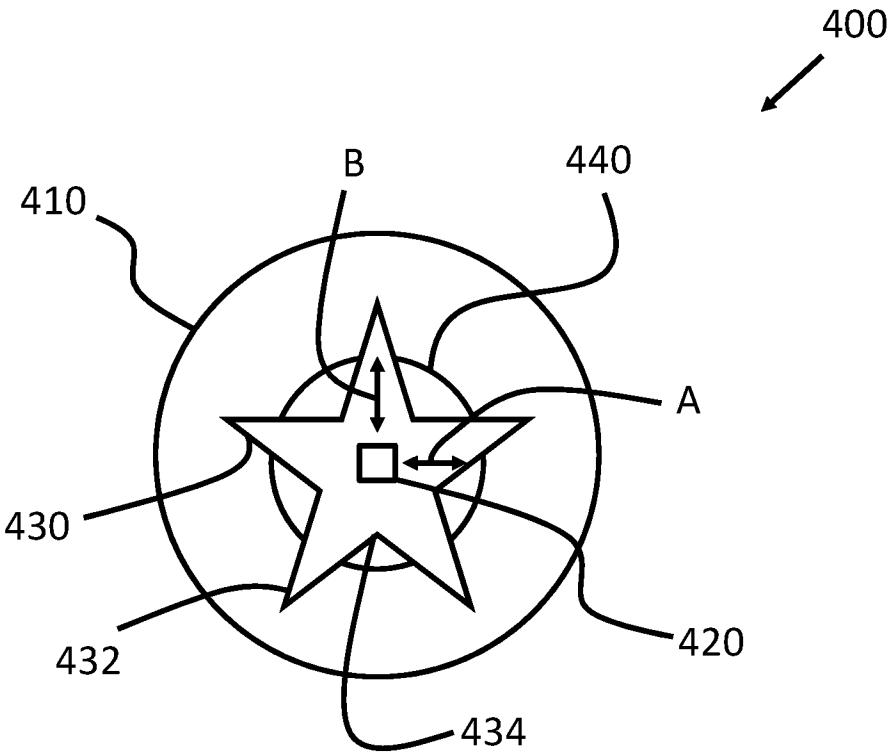
FIG. 4 is a transverse cross-sectional view of an aerosol provision system according to an example.

In the example of FIG. 4, an aerosol provision system 400 is shown. The aerosol provision system 400 is shown in a transverse cross-sectional view. The aerosol provision system 400 is similar to the system 300 shown in FIG. 3. A movement mechanism (not shown) may move the heating element 420 relative to the consumable 430. The movement mechanism may move the heating element 420 in the directions shown by arrow A and arrow B. By moving the heating element 420 in these two directions, the heating element 420 may be moved between specific troughs 434 to heat specific sections or portions of the aerosol generating material 440. This may lead to the production of a user-personalized aerosol by the system 400.

The movement mechanism may move the consumable 430 in the directions shown by arrow A and arrow B. In an example, the movement mechanism may be located at one end of the aerosol provision system 400 and be of a corresponding shape to fit within the channel formed inside the tubular corrugated surface 432. The "key and lock" fit of the consumable surface 432 and the movement mechanism may allow for the movement mechanism to be, for example, translated in the directions of arrows A and B. By translating the surface 432 and therefore moving the aerosol generating material 440 nearer to and further from the heating element 420, the system 400 may produce a desired, or personalized, aerosol.

Reducing the distance between the heating element 420 and the consumable 430 may increase the efficiency of aerosol generation. In the example wherein the heating element 420 is a resistive heater, the heat will transfer more efficiently over the shorter distance between the heater and the consumable 430. As such, a greater amount of aerosol will be provided during one heating process. As such, a power source of the aerosol provision system 400 is more efficiently used thereby improving the lifetime of the aerosol provision system on one full charge of the power source.

Figure 5:
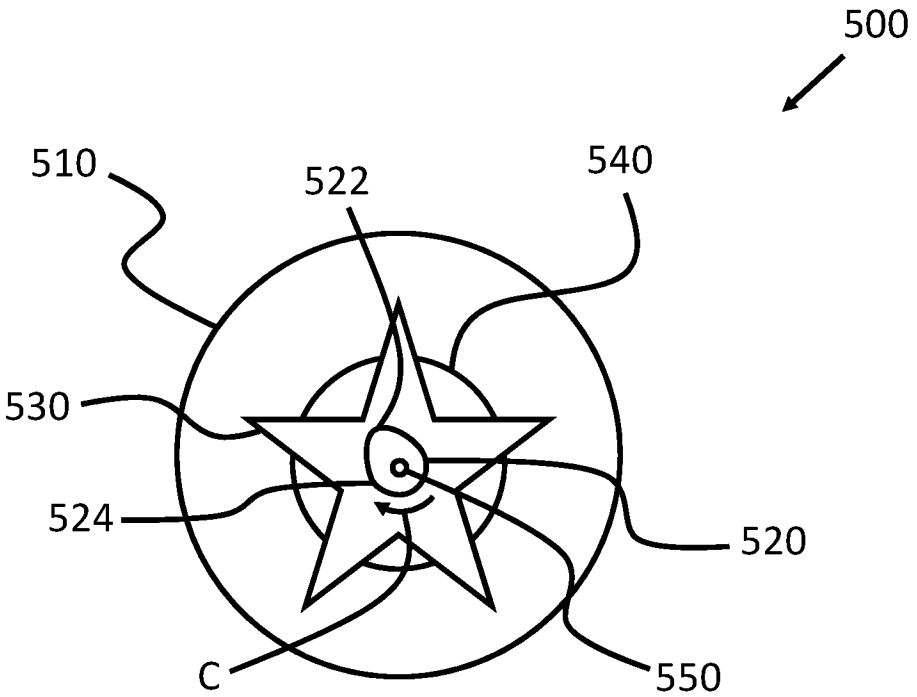
FIG. 5 is a transverse cross-sectional view of an aerosol provision system according to an example.

In the example of FIG. 5, an aerosol provision system 500 is shown. The aerosol provision system 500 is shown in a transverse cross-sectional view. The aerosol provision system 500 is similar to the system 400 shown in FIG. 4, similar features have similar numerals with the number increased by 100. These similar features will not necessarily be discussed in detail here.

The aerosol provision system 500 has a heating element 520. The heating element 520 has a forward portion 522 and a rear portion 524. The forward portion 522 may be shaped to project between troughs to allow efficient heat transfer to the aerosol generating material 540 in the troughs. The rear portion 524 may be shaped to not project between troughs (in the example of FIG. 5, the rear portion 524 is more retracted and rounded) such that control is provided over which troughs are selectively heated by the heating element 520.

The aerosol provision system 500 has a movement mechanism 550 in the form of an axle or the like. The movement mechanism 550 may be connected to the heating element 520 and may rotate the heating element 520 to, in effect, direct heat to particular troughs to heat particular portions of the aerosol generating material 540 in those troughs. The movement mechanism 550 may be permanently connected or removably connected to the heating element 520.

The movement mechanism of any of the disclosed embodiments may be arranged to provide relative movement between the heating element and the consumable substantially around an axis parallel to the axial direction. This may be rotation around the axis parallel to the axial direction, or translation in a somewhat circular manner around the axis parallel to the axial direction.

Figure 6:
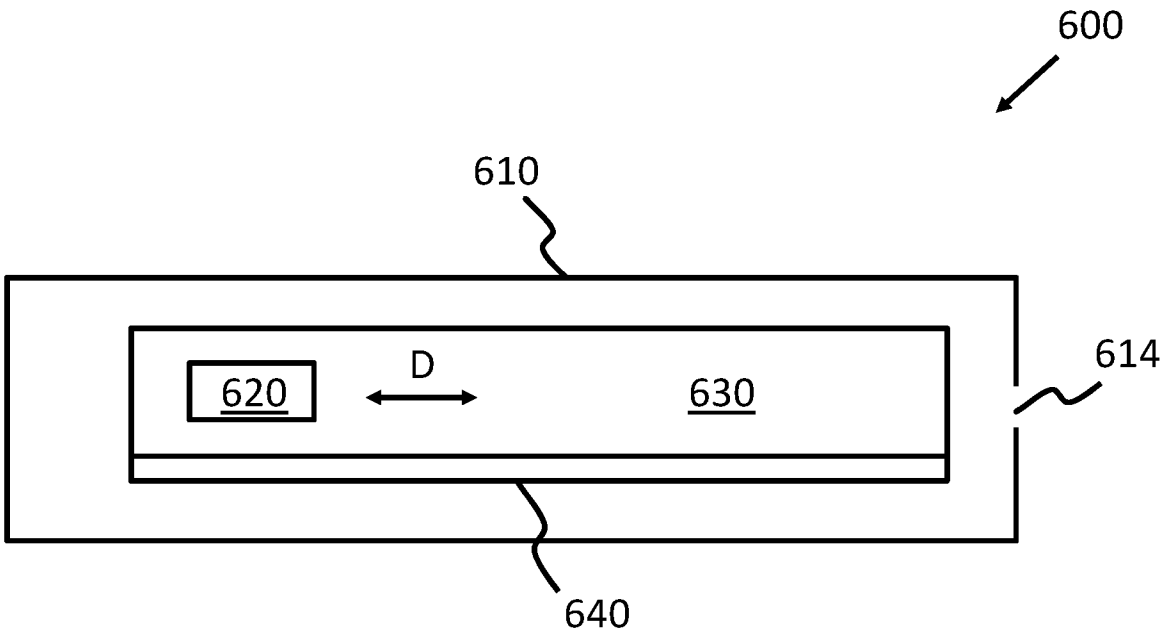
FIG. 6 is a longitudinal cross-sectional view of an aerosol provision system according to an example; and, FIG. 7 is a schematic flowchart for a method of producing an aerosol according to an example.
Figure 7:
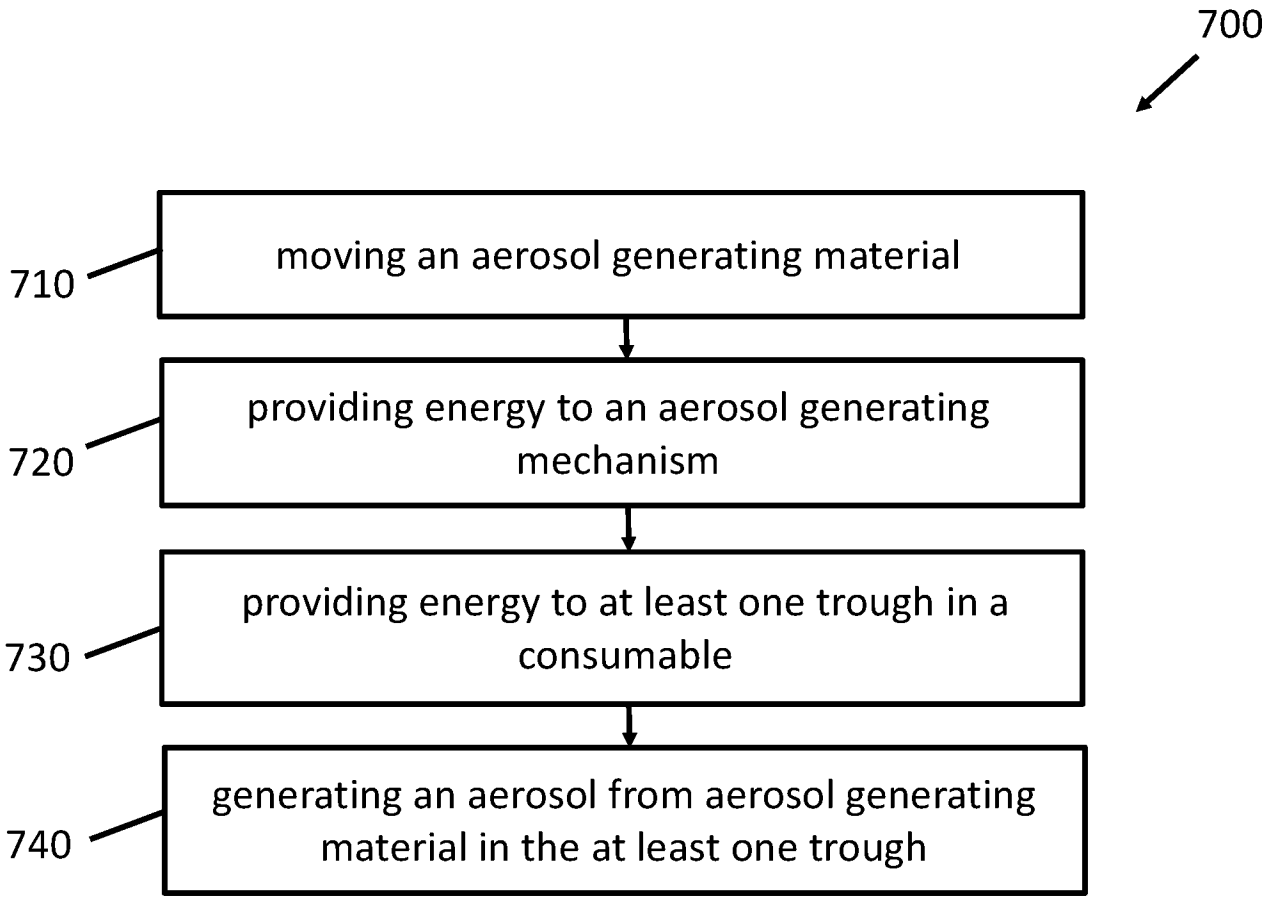

In the example of FIG. 6, an aerosol provision system 600 is shown. The aerosol provision system 600 is shown in a longitudinal cross-sectional view. The aerosol provision system 600 is similar to the system 400 shown in FIG. 4, similar features have similar numerals with the number increased by 200. These similar features will not necessarily be discussed in detail here.

The aerosol provision system 600 has a heating element 620 arranged within a consumable 630 which is arranged within the housing 610. In this specific cross section, aerosol generating material 640 is shown on a lower edge of the consumable 630, however it may surround or partially surround the consumable 630. The housing 610 has an outlet 614. The heater 620 may move relatively to the consumable 630 in the direction shown by arrow D. The movement mechanism (not shown) may provide the relative movement to the heating element 620 and/or the consumable 630. Movement in a direction parallel to the axial direction, allows the heating element 620 to provide heat to the aerosol generating material 640 arranged along the axial length of the consumable 630. As such, the full amount of aerosol generating material 640 on the consumable 630 may be aerosolized by the heating element 620, efficiently using the aerosol generating material 640 on the consumable 630. Furthermore, the arrangement shown in FIG. 6 is fairly space efficient in relation to the usefulness made of the space within the housing 610.

Any of the disclosed aerosol provision systems may have control circuitry arranged to control the heating element so as to provide a selection between at least a predetermined aerosol generating profile comprising a plurality of aerosolization phases and an aerosolization period to be applied to the aerosol generating material. The aerosolization period may be a period of continuous heating which may be provided as the default heating option of the aerosol provision system.

The predetermined aerosol generating profile may contain a series of heating periods separated by non-heating periods. The heating periods may have different operational temperatures, or target temperatures, for the heating element to reach. The non-heating periods may vary in length. The aerosol provision system may have a plurality of predetermined aerosol generating profiles which are designed to provide a user with a range of aerosol options based on the aerosol generating material provided on the consumable.

In an example, the aerosol provision system may have a controller for controlling the relative movement of the heating element and the consumable, for controlling the portions of aerosol generating material that are heated by the heating element. The controller may have predetermined movement instructions for providing the relative movement between the consumable and the heating element by the movement mechanism. The predetermined movement instructions may be part of or used alongside a predetermined heating profile to provide a predetermined aerosol from the aerosol provision system. The movement instructions and heating profile may be altered by the user to provide a personalized aerosol.

In an example, the aerosol provision system may have a sensor which is able to detect the consumable provided to the aerosol provision system. This detection may be signaled to the controller. The controller may have access to a database which enables the controller to recognize the consumable and subsequently be provided with the layout of the aerosol generating material on the carrier support. The controller may then control the relative movement of the heating element and the consumable to provide a desired aerosol to a user. This may be selected by a user from a predetermined plurality of heating profiles or be a bespoke heating profile which is created by the user.

The movement provided by the movement mechanism may be provided to the heating element. Moving the heating element in the aerosol provision system efficiently uses the space within the aerosol provision system. The consumable may be provided to fill some significant or large part of the aerosol provision system. The heating element may then be moved within that part of the aerosol provision system to then generate an aerosol from different regions of the consumable. This results from the heating element typically having a smaller area than the area of the consumable.

Alternatively, the movement provided by the movement mechanism may be provided to the consumable. The heating element will have associated electronics to receive electrical signals for operation. Moving the heating element may therefore involve also moving such electronics. Therefore, moving the consumable (which may have no associated electronics) is an organizationally simpler task. Furthermore, the consumable could be arranged on a moving surface to provide movement to the consumable. This may also operate to increase the ease of insertion of the consumable 320 into the aerosol provision system, e.g. if the moving surface assists moving the consumable 320 from an edge of the aerosol provision system to a central heating portion of the aerosol provision system. The moving surface may be a conveyor belt system or the like for providing entry to the aerosol provision system from an opening on the outer of the aerosol provision system to a heating portion inside the aerosol provision system.

In some embodiments, the non-combustible aerosol provision system is an electronic cigarette, also known as a vaping device or electronic nicotine delivery system (END), although it is noted that the presence of nicotine in the aerosolizable material is not a requirement.

In some embodiments, the non-combustible aerosol provision system is a tobacco heating system, also known as a heat-not-burn system.

In some embodiments, the non-combustible aerosol provision system is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system.

In some embodiments, the non-combustible aerosol provision device may comprise a power source and a controller. The power source may, for example, be an electric power source.

In some embodiments, the article for use with the non-combustible aerosol provision device may comprise an aerosolizable material, an aerosol generating component, an aerosol generating area, a mouthpiece, and/or an area for receiving aerosolizable material.

In some embodiments, the aerosol generating component is a heater capable of interacting with the aerosolizable material so as to release one or more volatiles from the aerosolizable material to form an aerosol.

The heater may comprise one or more electrically resistive heaters, including for example one or more nichrome resistive heater(s) and/or one or more ceramic heater(s). The one or more heaters may comprise one or more induction heaters which includes an arrangement comprising one or more susceptors which may form a chamber into which an article comprising aerosolizable material is inserted or otherwise located in use. Alternatively or in addition, one or more susceptors may be provided in the aerosolizable material. Other heating arrangements may also be used.

In some embodiments, the substance to be delivered may be an aerosolizable material. Aerosolizable material, which also may be referred to herein as aerosol generating material, is material that is capable of generating aerosol, for example when heated, irradiated or energized in any other way. Aerosolizable material may, for example, be in the form of a solid, liquid or gel which may or may not contain nicotine and/or flavorants. In some embodiments, the aerosolizable material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosolizable material may for example comprise from about 50 wt %, 60 wt % or 70 wt % of amorphous solid, to about 90 wt %, 95 wt % or 100 wt % of amorphous solid.

In some embodiments, the aerosol generating material may comprise one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

In certain embodiments, the aerosol-generating material comprises a gelling agent comprising a cellulosic gelling agent and/or a non-cellulosic gelling agent, an active substance and an acid.

The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In embodiments, the non-cellulose based gelling agent is alginate or agar.

The aerosol-generating material may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid can be in embodiments in which the aerosol-generating material comprises nicotine. In such embodiments, the presence of an acid may stabilize dissolved species in the slurry from which the aerosol-generating material is formed. The presence of the acid may reduce or substantially prevent evaporation of nicotine during drying of the slurry, thereby reducing loss of nicotine during manufacturing.

The aerosol generating material may comprise a colorant. The addition of a colorant may alter the visual appearance of the aerosol generating material. The presence of colorant in the aerosol generating material may enhance the visual appearance of the aerosol-generating material. By adding a colorant to the aerosol generating material, the aerosol generating material may be color-matched to other components of an article comprising the aerosol generating material.

A variety of colorants may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material comprising the amorphous solid. In some embodiments, the addition of a colorant to the amorphous solid renders it visually indistinguishable from other components in the aerosol-generating material.

The colorant may be incorporated during the formation of the aerosol generating material (e.g. when forming a slurry comprising the materials that form the aerosol generating material) or it may be applied to the aerosol generating material after its formation (e.g. by spraying it onto the aerosol generating material).

The aerosolizable material may comprise one or more active constituents, one or more carrier constituents and optionally one or more other functional constituents.

The active constituent may comprise one or more physiologically and/or olfactory active constituents which are included in the aerosolizable material in order to achieve a physiological and/or olfactory response in the user. The active constituent may for example be selected from nutraceuticals, nootropics, and psychoactives. The active constituent may be naturally occurring or synthetically obtained. The active constituent may comprise for example nicotine, caffeine, taurine, or any other suitable constituent. The active constituent may comprise a constituent, derivative or extract of tobacco or of another botanical. In some embodiments, the active constituent is a physiologically active constituent and may be selected from nicotine, nicotine salts (e.g. nicotine ditartrate/nicotine bitartrate), nicotine-free tobacco substitutes, other alkaloids such as caffeine.

In some embodiments, the active constituent is an olfactory active constituent and may be selected from a "flavor" and/or "flavorant" which, where local regulations permit, may be used to create a desired taste, aroma or other somatosensorial sensation in a product for adult consumers. In some instances such constituents may be referred to as flavors, flavorants, cooling agents, heating agents, or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional constituents may comprise one or more of pH regulators, coloring agents, preservatives, binders, fillers, stabilizers, and/or antioxidants.

In some embodiments, the article for use with the non-combustible aerosol provision device may comprise aerosolizable material or an area for receiving aerosolizable material. In some embodiments, the article for use with the non-combustible aerosol provision device may comprise a mouthpiece. The area for receiving aerosolizable material may be a storage area for storing aerosolizable material. For example, the storage area may be a reservoir. In some embodiments, the area for receiving aerosolizable material may be separate from, or combined with, an aerosol generating area.

Thus there has been described a method of generating aerosol from a consumable, the consumable comprising a corrugated surface having troughs extending along the consumable in an axial direction, the troughs being provided with aerosol generating material; the method comprising sequentially supplying heat to selected one or more troughs, such that at a given time, heat is directly applied to the selected one or more troughs by a heating element.

The aerosol provision system may be used in a tobacco industry product, for example a non-combustible aerosol provision system.

In one embodiment, the tobacco industry product comprises one or more components of a non-combustible aerosol provision system, such as a heater and an aerosolizable substrate.

In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in or on a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material, and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise an aerosol or aerosol generating agent or a humectant, such as glycerol, propylene glycol, triacetin or diethylene glycol.

In some embodiments, the aerosol-generating material comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The aerosol-generating material may comprise one or more cannabinoid compounds selected from the group consisting of cannabidiol (CBD) and THC (tetrahydrocannabinol).

The aerosol-generating material may comprise cannabidiol (CBD).

The aerosol-generating material may comprise nicotine and cannabidiol (CBD).

The aerosol-generating material may comprise nicotine, cannabidiol (CBD), and THC (tetrahydrocannabinol).

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, the entirety of this disclosure shows by way of illustration various embodiments that may be practiced and provide for a superior electronic aerosol provision system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of generating aerosol from a consumable, the consumable comprising a corrugated surface having troughs extending along the consumable in an axial direction, the troughs being provided with aerosol generating material;

the method comprising sequentially supplying heat to selected one or more troughs, such that at a given time, heat is directly applied to the selected one or more troughs by a heating element.

2. The method of claim 1, wherein the heat is supplied to portions of the consumable by activating the heating element.

3. The method of claim 1, wherein sequentially supplying the heat to selected ones of the troughs comprises moving the heating element relative to the consumable substantially along a direction perpendicular to the axial direction.

4. The method of claim 1, further comprising:

moving the heating element relative to the consumable substantially around an axis parallel to the axial direction.

5. The method of claim 1, wherein sequentially supplying the heat to portions of the consumable comprises moving the heating element relative to the consumable substantially along the axial direction.

6. The method of claim 1, further comprising:

moving the heating element relative to the consumable to provide contact between the heating element and the consumable.

7. The method of claim 1, wherein sequentially supplying the heat to portions of the consumable further comprises moving the heating element relative to the consumable to heat a first trough and then an adjacent trough.

8. The method of claim 1, further comprising selecting heating option from at least one of:

a predetermined heating profile comprising a plurality of heating phases; and a heating period, to be applied to the consumable.

9. An aerosol provision system comprising:

a heating element for generating an aerosol from an aerosol generating material; and, a consumable comprising a corrugated surface having one or more troughs extending along the consumable in an axial direction, the one or more troughs being provided with aerosol generating material;

the heating element arranged to supply heat to selected of the one or more troughs, such that at a given time, heat is directly applied to the selected of the one or more troughs by the heating element.

10. The aerosol provision system of claim 9, further comprising:

a movement mechanism arranged to provide relative movement between the heating element and the consumable substantially along a direction perpendicular to the axial direction.

11. The aerosol provision system of claim 10, wherein the movement mechanism is arranged to move the heating element relative to the consumable substantially along the axial direction.

12. The aerosol provision system of claim 10, wherein the movement mechanism is arranged to provide relative movement between the heating element and the consumable substantially around an axis parallel to the axial direction.

13. The aerosol provision system of claim 10, the consumable comprising a channel extending along the consumable in an axial direction wherein the heating element is, in use, arranged within the channel of the consumable.

14. The aerosol provision system of claim 10, further comprising:

control circuitry arranged to control the heating element so as to provide a selection between at least:

a predetermined aerosol generating profile comprising a plurality of aerosolization phases; and an aerosolization period, to be applied to the aerosol generating material.

15. The aerosol provision system of claim 9, wherein a first trough is provided with a first aerosol generating material and a second trough is provided with a second aerosol generating material, the first aerosol generating material and the second aerosol generating material being different aerosol generating media.

16. Aerosol provision means comprising:

an aerosol generating mechanism for generating an aerosol from an aerosol generating means; and, a consumable comprising corrugated surface means defining one or more troughs extending along the consumable in an axial direction, the one or more troughs being provided with the aerosol generating means, the heating element arranged to supply heat to selected of the one or more troughs, such that at a given time, heat is directly applied to the selected of the one or more troughs by the heating element.

* * * * *